United States Patent [19]

Henderson et al.

[11] 4,054,251

[45] Oct. 18, 1977

[54] DISPLACEMENT SENSING AND GUIDE APPARATUS

[75] Inventors: James G. Henderson, Dalton; David O. Hanon, Ringgold, both of Ga.

[73] Assignee: James G. Henderson, Dalton, Ga.

[21] Appl. No.: 683,168

[22] Filed: May 4, 1976

[51] Int. Cl.[2] ..... B65H 25/26

[52] U.S. Cl. ..... 242/57.1; 226/15

[58] Field of Search ..... 242/57.1; 226/15, 19, 226/20, 21, 22, 23

[56] References Cited

U.S. PATENT DOCUMENTS

| | | | |
|---|---|---|---|
| 2,726,858 | 12/1955 | Cherigie | 242/57.1 |
| 2,860,840 | 11/1958 | Jacobsen | 242/57.1 |
| 2,871,013 | 1/1959 | Markey | 242/57.1 |
| 3,232,547 | 2/1966 | Thiede | 242/57.1 |
| 3,323,699 | 6/1967 | Bricker | 226/15 |

*Primary Examiner*—Edward J. McCarthy

*Attorney, Agent, or Firm*—Jones, Thomas & Askew

[57] ABSTRACT

A displacement sensing and guide apparatus for continuous sheet material wherein the edges of a moving sheet of material are sensed by electromechanical or other variable voltage or variable impedance sensing and feedback means and communicate electrically with an electrical switching system, either directly or through a balanced bridge circuit, to operate the switching system and to indicate and to correct a displacement of the sheet material from a predetermined position.

19 Claims, 9 Drawing Figures

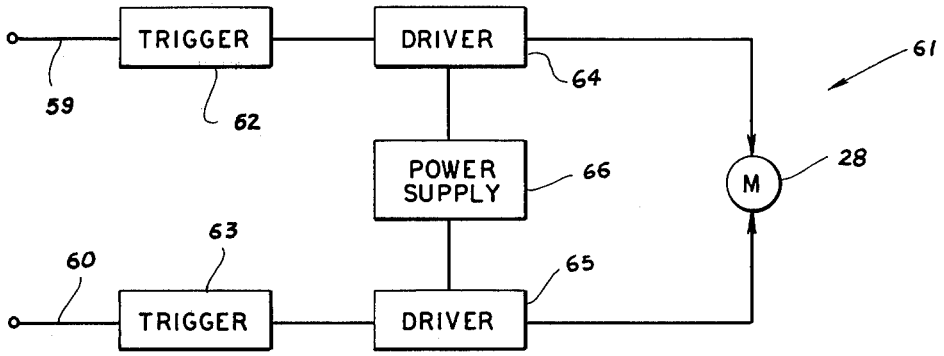
Fig. 5
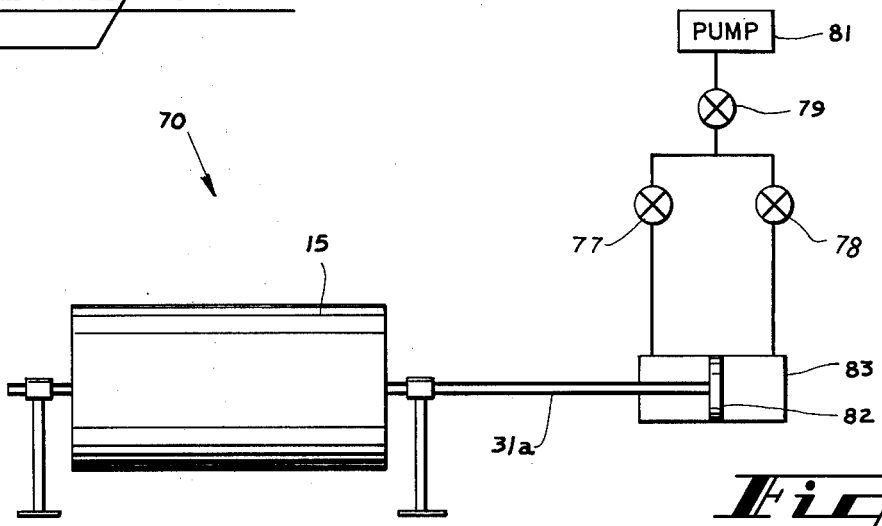
Fig. 7
Fig. 6
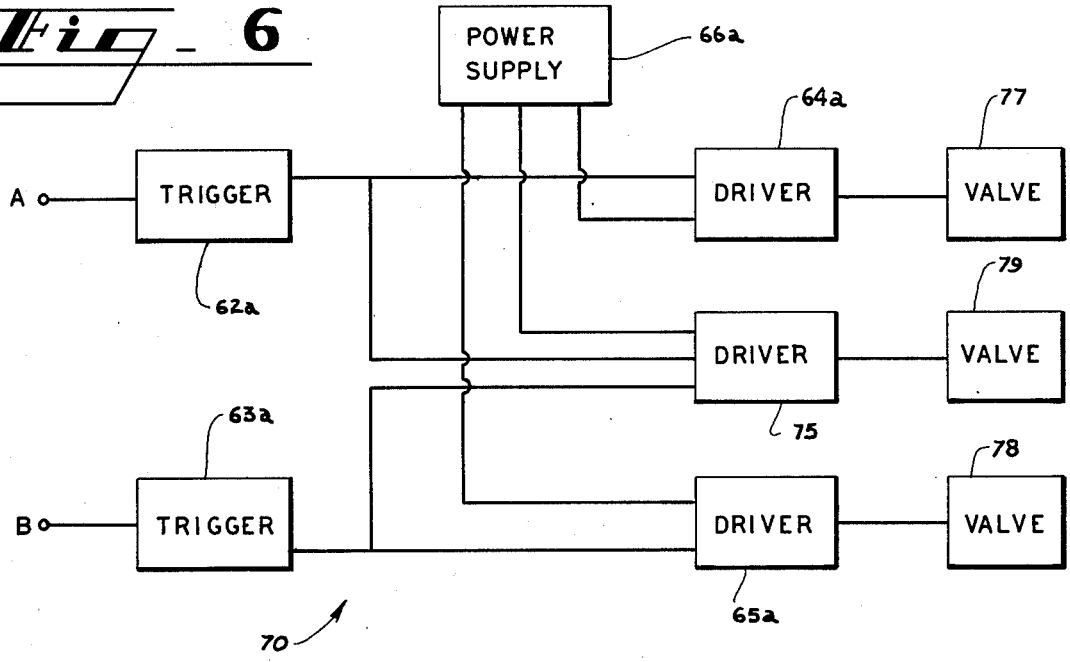

DISPLACEMENT SENSING AND GUIDE APPARATUS

BACKGROUND OF THE INVENTION

This invention relates to displacement sensing and guide systems, with particular application to machinery or processes which operate on materials in the shape of a continuous sheet or web and which require that the materials be introduced into and moved through a machine or a process without variance, either laterally or angularly from a predetermined position.

In the textile industry, the processes of cutting, printing, dyeing, or tufting continuous sheet fabrics or webs, or sewing one fabric over another fabric, require that the webs be properly aligned in the process. Furthermore, the alignment must be maintained despite varied widths along the length of the web. The webs are often very light or in insufficient tension to permit the direct use of any mechanical sensors, which requires either that the mechanical sensors measure a non-representative variable, such as the edge of a carpet backing sheet rather than the edge of the tufted pile of a tufted carpet, or that pressure or photoelectric sensors by used.

While the prior art discloses means for sensing deviations of moving webs from a desired path, most of these sensing means are incapable of directly measuring displacement of the edge of the web, or if the sensing means is photoelectric or pressure means capable of measuring displacement of an edge of the moving web, the sensing means requires sophisticated adjustment and it not readily adjustable for varying applications. Thus, the capability of a particular machine or process may be limited by the need for complicated adjustments whenever the width or desired displacement of the fabric, pile or web changes.

Since the design and arrangements of manufacturing equipment used in the textile industry is rarely static in the face of developing technologies, the means for sensing deviations of continuous webs from desired paths must be adapted to new configurations of processing machinery. The more the design of the sensing means must be specially designed for particular existing machines or processes, the less adaptable it is to the expected changes in machine configurations dictated by new processes.

The elaborate means of direct sensing by photoelectricity and fluid pressure usually require an investment in expensive components. The methods of indirect mechanical or electrical sensing require the measurements to be translated into useful indications by complex circuitry which also adds to their expense.

The result of these problems is that much of the present art in displacement sensing and guide means is expensive, difficult to maintain and to adjust the new uses, and, through its lack of adaptability, limits its users to existing technology. Furthermore, the extent to which the present art fails to satisfy the need for reliable and accurate displacement sensing and guide means emphasizes the need for improvement in this area.

SUMMARY OF THE INVENTION

Briefly described, the invention disclosed herein comprises a sensing means usable to detect one or both edge portions of a continuous sheet or web moving along a path so as to detect the lateral movement of the edge portions of the web away from their desired paths, and means responsive to the sensing means for moving the web back to the desired path. The sensing means comprises a variable voltage or variable impedance sensing and feedback means which communicates electrically with an electrical switching system to operate the switching system, and the switching system actuates a correction movement to guide the moving web back to its proper position.

Accordingly, it is an object of this invention to provide an accurate, reliable, versatile and inexpensive sensing and guide means for sensing the edges of a moving web or the like and for guiding the web along a predetermined path.

Another object of this invention is to provide a sensing and guide means for controlling the path of travel of a moving web or the like and which will accommodate varying widths of the web without adjustment and which is easily adapted to different machines or processes, or to new uses thereof.

It is another object of this invention to provide a sensing and guide means capable of directly measuring deviations of light fabrics or piles.

Another object of this invention is to provide sensing and guide means for a moving web or the like wherein the sensing means are capable of maintaining continuous registration with the web and continuous indication of the extent of the deviation of a portion of the web from its desired path of movement.

Further objects, features and advantages of the invention will become apparent upon reading the following specification and referring to the accompanying drawings.

DESCRIPTION OF THE DRAWINGS

FIG. 5 is a block drawing of the electric motor shifting means.

FIG. 6 is a block drawing of the hydraulic shifting means.

FIG. 7 is a schematic drawing of the hydraulic shifting means.

DETAILED DESCRIPTION OF THE EMBODIMENTS

Figure 1:
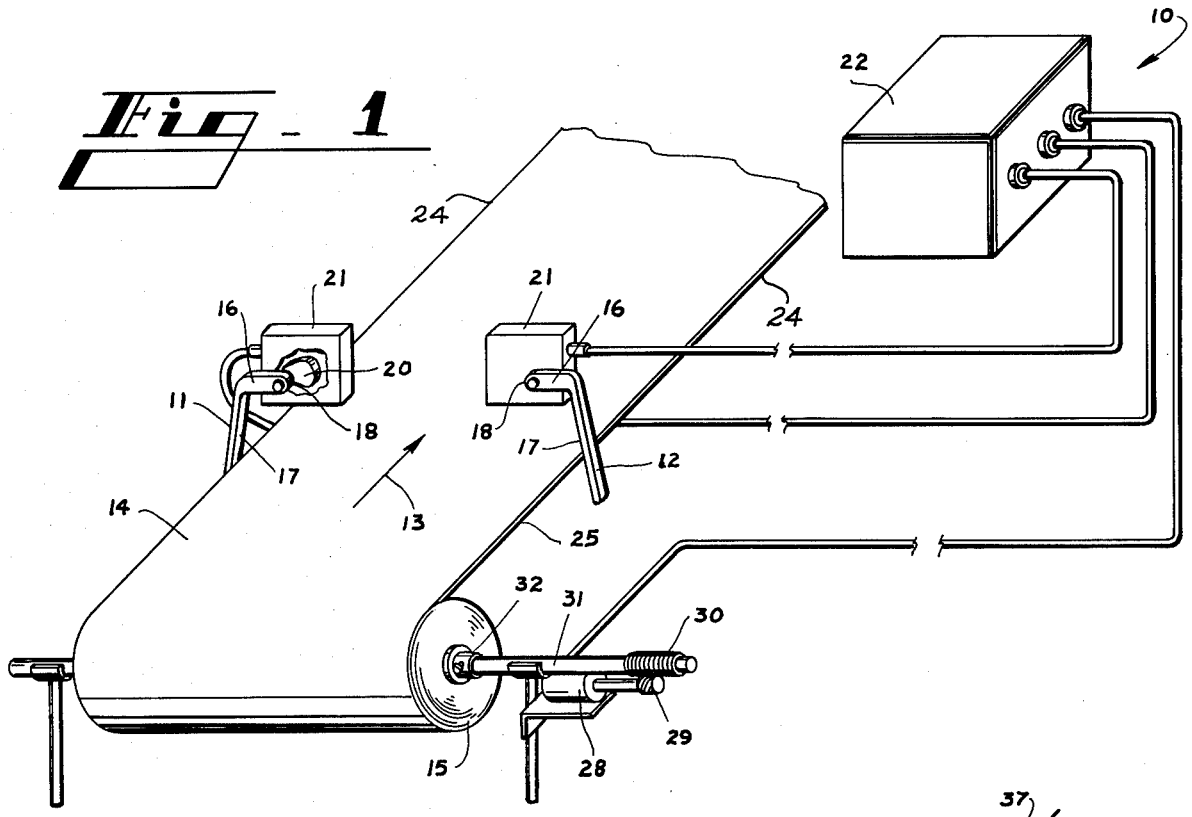
FIG. 1 is a pictorial view of an embodiment of the displacement sensing and guide means, particularly illustrating the elongate sensors and the electrical displacement adjustment means.

Referring now to FIG. 1, the means for providing a first and second voltage which varies in response to the change in position of an edge of the moving web at a position along the path, a variable impedance displacement sensing and guide means 10, comprises sensing arms 11 and 12 positioned on opposite sides of the normal path of travel 13 of the continuous web of material 14 which is taken from reel 15 or other source of supply and moved through a machine or process (not shown). The sensing arms 11 and 12 are constructed of light metal and are approximately L-shaped with one length 16 of each sensing arm extending externally over the web and the other length 17 of each sensing arm extending in a downward direction at the edge of the web. The end portion 18 of the laterally extending length of each sensing arm is pivotally attached to potentiometers 20 carried in the housings 21. The potentiometers 20 are electrically connected with the switching circuit which functions as means for comparing the first or second voltage with another voltage or with each other and are housed in the control box 22. The L-shaped of the sensing arms 11 and 12 and the pivotable connection at the ends of the upper laterally extending length of the sensing arms causes the sensing arms to be urged by gravity continuously into contact with the edges 24 and 25 of the web 14.

An electric motor means responsive to the comparison of the voltages for guiding the movement of the web 14 is electrically connected to and is controlled by the switching circuit housed in the control box 22. The electric motor functions to shift the reel 15, as by being supported adjacent the support rod of the reel of the web of material and to rotate worm gear 29. Worm gear 29 engages the annular protrusions of collar 30, and collar 30 is rigidly connected to reel support shaft 31. Holding collars 32 are mounted on reel support shaft 31 on opposite sides of the reel 15. Thus, motor 28, gear 29, collar 30 and their related elements comprise a web adjusting means responsive to sensing and feedback means 10 and function to laterally shift the web as it moves from its supply.

Figure 2:
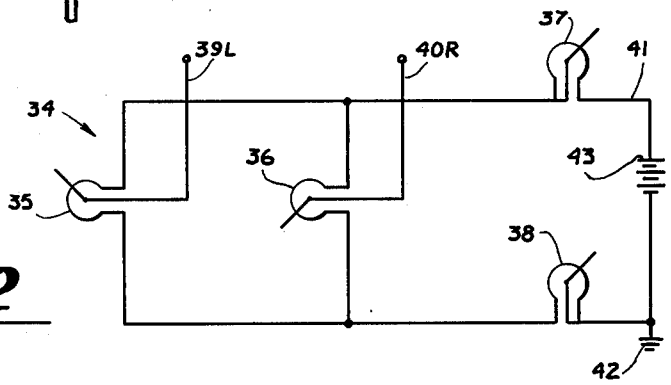
FIG. 2 is a schematic drawing of the variable voltage sensing and feedback circuit.

Referring now to FIG. 2, the variable voltage sensing and feedback circuit 34 comprises a pair of variable impedance displacement sensing and feedback means 35 and 36, each electrically connected in series with an adjustable voltage source, trim potentiometers 37 and 38, respectively, with voltage outputs at voltage comparison points 39L and 40R; and a voltage source 43 across points 41 and 42.

Figure 3:
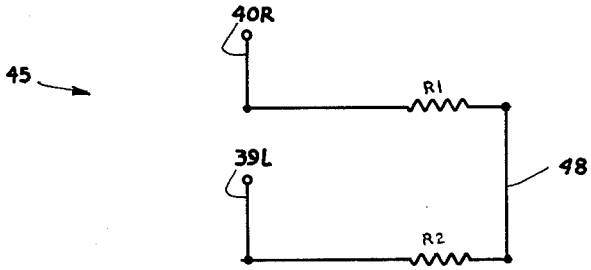
FIG. 3 is a schematic drawing of the voltage comparison circuit.

Referring now to FIG. 3, the voltage comparison circuit 45 between the variable voltage sensing and feedback circuit 34 and the switching means 50 for providing a corrective movement of the web in response to deviations of the web sensed by said sensing and feedback circuit comprises dual variable voltage inputs, a first voltage input at voltage comparison point 40R and a second voltage input at voltage comparison point 39L, each connected in series with a source of impedance resistances R1 and R2, respectively, and connected to an common point 48.

Figure 4:
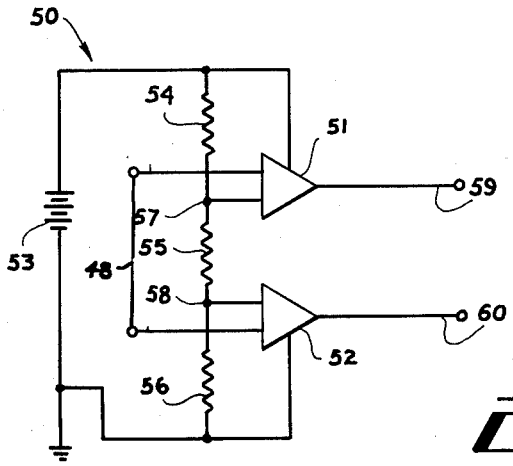
FIG. 4 is a schematic drawing of the switching circuit.

Referring now to FIG. 4, the switching means 50 for sensing the voltage at the common point 48 and for providing a corrective output responsive to deviations sensed by the sensing and feedback circuit 34 comprises a duality of operational amplifiers, 51 and 52; a positive input to operation amplifier 51 and a negative input to operational amplifier 52 provided by the output voltage at the common point 48 from the voltage comparison circuit 45; a voltage divider circuit comprised of a voltage source 53 across three voltage divider resistors, 54, 55 and 56, with outputs at 57 and 58; a negative input to operational amplifier 51 and a positive input to operational amplifier 52 provided by the outputs 57 and 58, respectively, of the voltage divider circuit; and outputs from the operational amplifiers 51 and 52, at 59 and 60, respectively.

Referring now to FIG. 5, the corrective adjustment means 61 for guiding the movement of the web responsive to the comparison of the voltages by the switching means 50, comprises dual hysterisis triggering circuits 62 and 63 responsive to the output voltages at 59 and 60, respectively, drivers 64 and 65 responsive to the output of said triggering circuits 62 and 63, respectively, powered by a power supply 66; and the electric motor 28 which is responsive to the output of the drivers 64 and 65.

Referring now to FIG. 6, an alternative embodiment of the corrective adjustment means 70 for guiding the movement of the web responsive to the comparison of the voltages by the switching means, comprises a dual hysterisis triggering circuits **62*a* and 63*a* responsive to the output voltages at 59 and 60, respectively, drivers 64*a* and 65*a* responsive to the output of said triggering circuits 62*a* and 63*a*, respectively, driver 75 responsive to the outputs of both triggering circuits 62*a* and 63*a*, a power supply 66*a* for providing power to drivers 64*a*, 65*a*, and 75; and valves 77, 78, and 79 responsive to drivers 64*a*, 65*a* and 75,** respectively.

Referring now to FIG. 7, the alternative corrective adjustment means 70 further comprises pump 81 which functions as a means for providing hydraulic pressure and which communicates hydraulically with a piston 82 and cylinder 83 through valves 77, 78 and 79 and a mechanical linkage **31*a* which transmits the adjustment to the roll 5.**

Prior to the operation of the displacement sensing and guide apparatus 10, it is necessary to set the trim potentiometers 37 and 38 so that when the desired alignment of the center line of the web 14 is established at the outset, the displacement sensing and guide apparatus will neither indicate any deviation nor initiate any adjustment. As will be explained, such a state exists in the preferred embodiment only when the voltages at 40R and 39L are equal. Therefore, the trim potentiometers 37 and 38 must be adjusted so that, given the output voltages at 39L and at 40R created by the desired alignment of the center line of the web 14, the sum of the voltage drop between 41 and 40R across the trim potentiometer 37 and the right variable impedance sensing and feedback means 36 is equal to the sum of the voltage drop between 39L and 42 across the left variable impedance sensing and feedback means 35 and the trim potentiometer 38.

When the sensing and guide apparatus is thus set to the desired alignment for the center line of the web 14, the electrical state in the voltage comparison circuit 45 is such that the voltage at the common point 48 is half the voltage at point 41. This electrical state will be maintained wherever the voltage outputs at voltage comparison points 39L and 40R from the variable impedance displacement and feedback means 35 and 36 on both sides of the sensing and guide apparatus, as adjusted by the trim potentiometers 37 and 38, are equal that is when both sides are balanced.

Once the desired alignment for the center line of the web 14 has been established by adjustment of the trim potentiometers 37 and 38, the displacement sensing and guide apparatus operates as follows: any deviation in the displacement of the web 14 from its desired position will be mechanically detected by either one or both of the variable impedance sensing and feedback means 35 or 36 and will be proportionately reflected in the output voltages at either voltage comparison point 39L or voltage comparison point 40R respectively. The choice of the output points 39L and 40R in the sensing and feedback circuit is such that any deviation of a surface of uniform width in one direction will create an increase in one output voltage and a corresponding equal decrease in the other output voltage. The imbalance thus induced by the deviation from the desired displacement will not, however, cause the voltage difference between 40R and 39L across the two equal voltage divider resistors R1 and R2 to change and that value will remain constant. Nonetheless, the change in the voltages across each of the variable impedance sensing and feedback means 35 and 36 which result in changes in the output voltages at 39L and 40R will cause the voltage at the common point 48 to deviate from the desired value of half the voltage at 41 whenever the web 14 is displaced from its desired alignment. To illustrate, a displacement from the desired alignment of the web 14 to the right will cause an increase in the voltage drop between 41 and 40R and, assuming the width of the web 14 is uniform, an equal decrease in the voltage drop between 39L and 42 resulting in a decrease in the voltage at the common point 48 and a negative deviation from the desired value for the voltage at common point 48 of half the voltage at 41. Conversely, a displacement from the desired alignment of the web 14 to the left will result in the value of the voltage at the common point 48 being greater than the desired voltage of half the voltage at 41.

The deviation in the voltage from the desired voltage at the common point 48, which is half the voltage at 41, is compared by the operational amplifiers 51 and 52, with the voltages at voltage divider outputs 57 and 58, respectively, which are respectively slightly above and slightly below the desired voltage at the common point 48 of half the voltage at 41, depending upon the relative magnitude of the dead band resistance at 55 in comparison with the magnitudes of the resistances at 54 and 56. If the output voltage at the common point 48 is in excess of the voltage at voltage divider output 57, then the operational amplifier 51 performs a switching function and an output voltage is created at 59. Conversely, if the voltage at is less than the voltage at the voltage divider output 58, then the operational amplifier 52 performs a switching function and an output voltage is created at 60. Thus, a sufficiently large displacement to the left by the web 14 from its desired alignment will cause the output voltage at the common point 48 to exceed the upper voltage limit created by the dead band at the voltage divider output 57 and will create an output voltage at 59. Conversely, a sufficiently large displacement to the right by the web 14 of its desired alignment will cause the output voltage at the common point 48 to drop below the lower voltage limit created by the dead band at the voltage divider output 58 and will create an output voltage at 60.

The output voltages thus created at either 59 or 60 by displacements to the left or right respectively from the desired alignment of the web 14, operate hysterisis triggering circuits 62 and 63, respectively. In the case of the embodiment using electrical motor adjustment means 28, said triggering circuits 62 and 63 in turn operate drivers 64 and 65, respectively, powered by a power supply 66, to operate the electric motor adjustment means 28, to cause a corrective adjustment of the roll 15 by said electric adjustment means 28 through the worm gear 29 or other mechanical linkage either to the right or to the left, respectively. These corrective adjustments continue for the full duration of the period the output voltages at 59 or 60 operate the triggers 62 or 63; that is, until the voltage at the bridge 48 is again within the limits of the dead band defined by the voltage at the voltage divider output 57 and the voltage divider output 58.

In the case of the alternative embodiment 70 using hydraulic adjustment means, the triggering circuits **62*a* and 63*a* operate drivers 64*a* and 65*a*, respectively, powered by a power supply 66*a* to open valve 79 and either valve 77 or 78 to cause a corrective adjustment of the roll 15 by the hydraulic piston 82 through the mechanical linkage 31*a* either to the right or to the left, respectively. These corrective adjustments continue for the full duration of the period that the output voltage at either 59 or 60 operates trigger 62*a* or 63*a* respectively, that is, until the voltage at the bridge 48 is again within the limits of the dead band defined by the voltage divider output 57 and the voltage divider output 58.**

The operation of the embodiments of this invention is further demonstrated and the nature of its alignment guide illustrated by considering the corrective adjustments made when, during the course of unrolling, the web 14 varies in width. If the variation in width on both sides of the roll is uniform such that the same center line is maintained, the opposing voltages at voltage comparison points 40R and 39L will remain balanced and no corrective adjustment will occur. If, however, the rate of the variation in width on one side of the former center line is greater than the other, the displacement sensing and guide apparatus will correctively adjust to align the newly established center line with the desired center line position set at the outset by the trim potentiometers 37 and 38. To illustrate the manner in which such a correction is made, an increase in width on the left side of the former center line of the web 14 will be hypothesized. This further displacement of the left edge 24 of the web 14 will cause the sensor 11 to be mechanically displaced and the voltage output at voltage comparison point 39L to be increased. The increase in the voltage output at the voltage comparison point between 39L without a corresponding increase in the voltage output at the voltage comparison point 40R causes the voltage drop 40R-39L across resistors R1 and R2 to change; this change in voltage is divided by the resistors R1 and R2 so that the change is distributed equally on both sides of the common point 48. Thus, the net change in the voltage at the common point 48 is an increase in voltage of only half the magnitude of the increase in the voltage output at voltage comparison point 39L caused by the displacement of the left edge 24 of the web 14. This deviation from the desired voltage at the common point 48 will cause a corrective adjustment to the right which will continue until this increase at the bridge 48 is diminished by the simultaneous decrease in the voltage output at voltage comparison point 39L and increase in the voltage output at voltage comparison point 40R as the correction is made, that is, the corrective adjustment will stop after a correction to the right of half the increased width of the web 14 has been made, at which point the voltage outputs at voltage comparison points 39L and 40R will again have become equal and the common point 48 will have been restored to its initial desired value.

The fact that the center line of the web 14 is the point to which the preferred embodiment of the displacement sensing and guide apparatus corrects suggests a further variation in its applicability. In an application which requires that one edge of the surface be maintained at a constant displacement from a fixed predetermined point, that distance may be used as a hypothetical center line by using only one variable impedance sensing and feedback means along the edge and, upon positioning the edge of the surface at the desired position, setting the voltage at the other variable impedance sensing and feedback means to equal the voltage at the variable impedance sensing and feedback means contacting the edge. In this case, the fact that only one output voltage will be variable will cause the corrective adjustments to be equal in magnitude to the full displacement of the one edge from the desired alignment since the other voltage, being fixed, will not reflect the corresponding shift of the opposite edge of the surface, and, therefore, will be unable to contribute to making the output voltages again equal as the correction is made. Thus, even though only one edge is displaced, the correction will compensate for the full displacement rather than the half displacement correction which would be the case if the corrective movement of the opposite edge was also reflected by a circuit variable, and the correction was being made to the actual center line.

Figure 8:
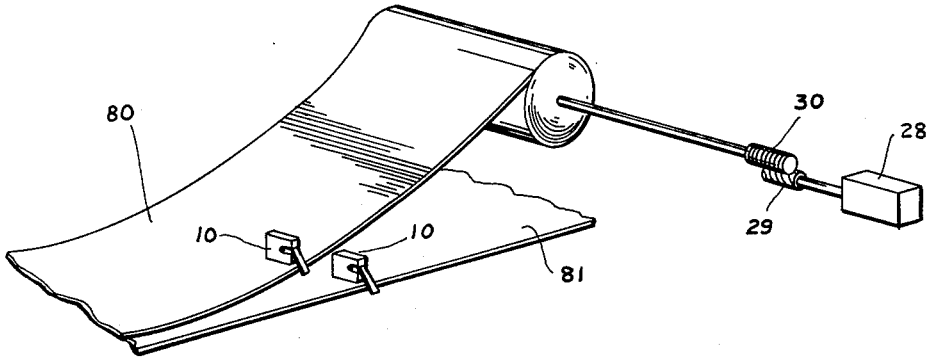
FIG. 8 is a pictorial view of an application of the displacement sensing and guide means to align the edges of two overlapping webs of material.

Referring now to FIG. 8, another application of the preferred embodiment of the invention is the use of one variable impendance displacement sensing and feedback means 10 to sense or detect the position of one web 81 while using the other variable impedance displacement sensing and feedback means 10 to sense or detect the position of a second web 80 of material relative to the first while the second web 80 is being fed in an overlying position or to the first web 81.

Figure 9:
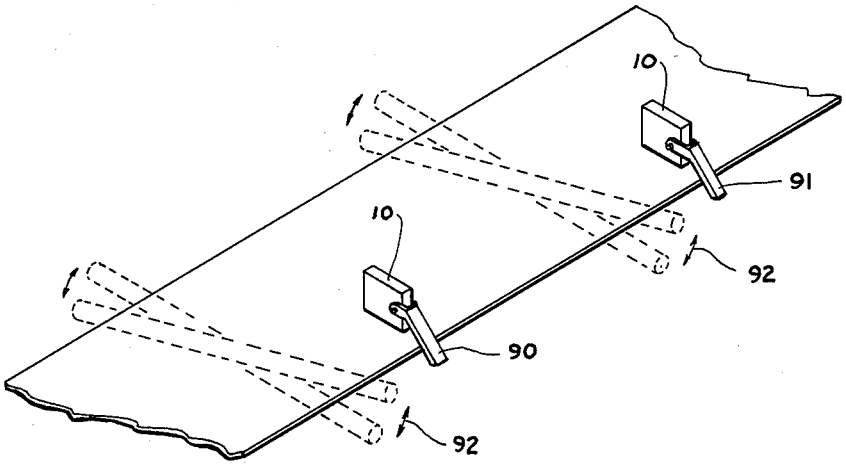
FIG. 9 is a pictorial view of an application of the displacement sensing and guide means to maintain the angular position of a web.

Referring now to FIG. 9, another application of the preferred embodiment of the invention is the use of one variable impedance displacement sensing and feedback means 10 to sense or detect the position of the edge of the web at one point 90 while using the other variable impedance displacement and sensing and feedback means 10 to sense or detect the position of the same edge of the web at a different point 91 along its path. This facilitates the continued angular position of the web as it follows its path. In such a case, the corrective adjustment means would be provided by angularly adjustable rollers 92 beneath the web.

Although the embodiments of the invention have been disclosed as sensing and guiding a web or the like moving from a reel or other supply, it should be understood that the invention can be used in connection with other continuous or long lengths of sheet material, and that the sheet material can be moved or guided by laterally shifting the running sheet or by other movement means. Moveover, although certain embodiments of the invention have been described herein, the disclosed embodiments are illustrative only; the invention is limited solely by the appended claims.

We claim:

1. A displacement sensing and guide apparatus for guiding a moving web or the like along a path comprising:

a first voltage means for providing a first voltage which varies in response to the change in position of an edge of the moving web at a position along the path;

a second voltage means for providing a second voltage, a circuit electrically connected between said first voltage means and said second voltage means, including a first source of impedence and a second source of impedence;

a switching means responsive to a change of a preselected magnitude in the voltage at the point in said circuit between said first source of impedence and said second source of impedence for providing an output; and a means responsive to the output of said switching means for guiding the movement of the web.

2. The displacement sensing and guide apparatus of claim 1 wherein said second voltage means is responsive to the change in position of the opposite edge of the moving web at a position along the path.

3. The displacement sensing and guide apparatus of claim 1 wherein said second voltage means is responsive to the change in position of the edge of another moving web at a position along the path of the second moving web.

4. The displacement sensing and guide apparatus of claim 1 wherein said second voltage means is responsive to the change in position of the same edge of the moving web at a second position along the path.

5. The displacement sensing and guide apparatus of claim 1 wherein said first voltage means comprises an elongated displacement sensing arm pivotally attached to a variable voltage source.

6. The displacement sensing and guide apparatus of claim 1 wherein said first voltage means comprises an elongated displacement sensing arm pivotally attached to a potentiometer.

7. The displacement sensing and guide apparatus of claim 1 wherein said first voltage means comprises an adjustable voltage source in series with a source of voltage which is responsive to the change in position of an edge of the moving web.

8. The displacement sensing and guide apparatus of claim 1 wherein said second voltage means is responsive to the change in position of an edge of a moving web at a position along its path, and wherein both said first voltage means and said second voltage means each comprises an adjustable voltage source in series with a source of voltage responsive to the change in position of an edge of a moving web.

9. A displacement sensing and guide apparatus for controlling the position of a moving length of web material or the like comprising:

variable resistance displacement sensing and feedback means for sensing an edge portion of the web;

switching means, responsive to the output voltage of said variable resistance displacement sensing and feedback means for causing an output; and displacement adjustment means responsive to the output of said switching means for adjusting the position of said web.

10. A displacement sensing and guide apparatus in accordance with claim 9 wherein said variable resistance displacement sensing and feedback means comprises an elongated displacement sensing arm rotatably attached to a variable resistance source.

11. A displacement sensing and guide apparatus in accordance with claim 9 wherein said variable resistance displacement sensing and feedback means comprises an elongated displacement sensing arm rotatably attached to a potentiometer.

12. A web displacement sensing and guide apparatus comprising a plurality of variable resistance web displacement sensing and feedback means for sensing an edge portion of the web, each comprising an elongated displacement sensing arm pivotally attached to a potentiometer and electrically connected in a series with a trim potentiometer, electrically connected at a common point; switching means responsive to the voltage at said common point for causing an output; and a displacement adjustment means responsive to the output of said switching means for adjusting position of said web.

13. A web displacement sensing guide apparatus in accordance with claim 12 wherein said variable resistance web displacement sensing and feedback means comprises an elongated displacement sensing arm pivotably attached to said potentiometer and urged by gravity into the edge of the web.

14. A displacement sensing and guide apparatus in accordance with claim 12 wherein said displacement adjustment means comprises electric motor means for adjusting the position of said web.

15. A displacement sensing and guide apparatus in accordance with claim 12 wherein said displacement adjustment means comprises hydraulic means for adjusting the position of said web.

16. A displacement sensing and guide apparatus for guiding a moving web or the like along a path comprising:

a first voltage means for providing a first voltage comprising an adjustable voltage source in series with a source of voltage which is responsive to the change in position of an edge of the moving web;

a second voltage means for providing a second voltage, a circuit electrically connected between said first voltage means and said second voltage means;

a switching means responsive to the voltage in said circuit for providing an output; and a means responsive to the output of said switching means for guiding the movement of the web.

17. The displacement sensing and guide apparatus of claim 16 wherein said second voltage means includes an adjustable voltage source in series with a source of voltage responsive to the change in position of an edge of the moving web.

18. The displacement sensing and guide apparatus of claim 16 wherein said source of voltage which is responsive to the change in position of an edge of the moving web further includes an elongated displacement sensing arm pivotaly attached to a variable voltage source.

19. The displacement sensing and guide apparatus of claim 18 wherein said variable voltage source is a potentiometer.

* * * * *